United States Patent [19]

Holzer

[11] 4,356,855

[45] Nov. 2, 1982

[54] VANE HOLDING ASSEMBLY

[75] Inventor: Joseph C. Holzer, Liverpool, N.Y.

[73] Assignee: Joanna Western Mills Company, Chicago, Ill.

[21] Appl. No.: 282,944

[22] Filed: Jul. 13, 1981

[51] Int. Cl.[3] ..... E06B 9/38

[52] U.S. Cl. ..... 160/178 R

[58] Field of Search ..... 160/166–178, 160/183

[56] References Cited

U.S. PATENT DOCUMENTS

| | | | |
|---|---|---|---|
| 2,625,219 | 1/1953 | Peck | 160/168 |
| 3,125,154 | 3/1964 | Woodle | 160/178 |
| 3,205,935 | 9/1965 | Cryton | 160/183 |
| 3,283,805 | 11/1966 | Kirtley et al. | 160/178 R |
| 3,298,425 | 1/1967 | Cayton et al. | 160/176 |
| 3,516,473 | 6/1970 | Rosenquist | 160/183 |
| 4,116,257 | 9/1978 | Bratschi | 160/168 |

*Primary Examiner*—Peter M. Caun

*Attorney, Agent, or Firm*—Bean, Kauffman & Bean

[57] ABSTRACT

A vane holding assembly for suspending a vertical vane formed of a pliable material from a hook of a venetian blind mechanism includes an elongated housing defining a downwardly opening cavity bounded in part by opposite side walls formed with a plurality of ribs projecting inwardly of the cavity, and an elongated vane holding bar for insertion into the cavity between the ribs; the holding bar having an elongated mounting slot for receiving an upper end of a vane in folded relation, whereby as the holding bar is inserted into the housing the opposed ribs engage and frictionally secure the folded vane relative to the holding bar. The housing is additionally provided with an upper opening permitting insertion of the hook within the cavity for connection to the holding bar.

6 Claims, 5 Drawing Figures

3
4
10
12
14
14a
14b
14c
14d
14e
14f
16
18
20
22
24a
24b
24c
24d
26
30a
30b
30c
32
34
34a
36

VANE HOLDING ASSEMBLY

BACKGROUND OF THE INVENTION

The present invention relates to a vane holding assembly, and, more particularly, to such an assembly for adjustably and removably supporting fabric or other pliable material vanes of the type employed as vertically disposed strip curtains, venetian blinds, louvers and the like.

Various types of pliable vane holding devices are known, as typified by the inventions disclosed in prior U.S. Pat. Nos. 2,625,219; 3,125,154; 3,298,425 and 4,116,257.

In the constructions of U.S. Pat. Nos. 3,125,154; 3,298,425 and 4,116,257 cloth or fabric vanes of fixed length are seamed and have bars or inserts fitted through the seams for attachment to carriers or the like. This type of construction does not easily permit adjustments of the lengths of the vanes in the event of vane shrinkage, nor does the same easily permit standard sized vane lengths to be adjusted as required to accommodate for non-standard or customized vane installations.

On the other hand, U.S. Pat. No. 2,625,219 does disclose an arrangement which will permit vane length adjustments. To this end, the end of the vane is fitted through an elongated slot in a vane holding plate and positively locked in place by means of an elongated spring clip, which presses the fabric through the slot. Although this construction will inherently permit adjustments in vane length, in the event of shrinkage or the like, a drawback thereof is that it lacks an aesthetically pleasing, neat-looking appearance which, obviously, is extremely important in decorative window arrangements. A further drawback is that it is not readily removable from its associated vane carrier.

An additional drawback of all pliable vane holding devices of which I am aware is that they are unsuited for use in combination with resilient hook support devices of the type disclosed for instance in U.S. Pat. Nos. 3,516,473; 4,122,884 and 4,140,169.

SUMMARY OF THE INVENTION

The foregoing problems of the prior art, as well as others not specifically mentioned, are overcome according to the teachings of the present invention, which provides a vane holding assembly characterized as being extremely versatile, inexpensive, easy to manufacture, simple to use and susceptible to installation with varying length vanes, without the necessity of sewing or gluing to obtain the desired fit or adjustment. Another significant feature of the present invention is to provide a holding assembly adapted for use in permitting the mounting of pliable vanes on hook support devices of the general type disclosed in U.S. Pat. Nos. 3,516,473, 4,122,884 and 4,140,169. Moreover, the present holding assembly accommodates itself for use with hooks having different projected lengths, i.e. that length or portion of a hook projecting beyond its associated trackway, thereby to permit a desired minimum spacing to be maintained between the present assembly and the trackways of numerous commercially available blind installations of competitive manufacture. It is, accordingly, extremely easy for a user to employ the vane holding assembly of this invention to install new or replacement vanes in existing structures of different manufacture, as well as to adjust previously installed vanes to accommodate for any shrinkage thereof.

Essentially, then, the present invention provides a vane holding assembly for pliable material vanes, such as pliable plastic sheet, fabric, cloth or treated paper vanes, comprising: an elongated housing defining an interior cavity having a plurality of vertically disposed ribs extending thereinto from opposite or opposed longitudinal walls thereof; and an elongated vane holding bar insertable into the cavity between the ribs. The bar is provided with a longitudinally extending slot for receiving an end of a pliable material vane, whereby as the bar is inserted into the housing cavity, the ribs frictionally engage and securely fasten the end of the vane in place. An upper wall of the housing is formed with a centrally located opening sized to receive an end of a conventional vane supporting hook and the bar is provided with at least one hook receiving slot arranged within the housing in vertical registration with the housing opening for operably receiving the hook, whereby to support the whole of the present assembly and its associated vane relative to the blind supporting trackway.

BRIEF DESCRIPTION OF THE DRAWINGS

For a fuller understanding of the present invention, reference is now made to the following detailed description taken in conjunction with the accompanying drawing, wherein.

DETAILED DESCRIPTION

Figures 1, 2, 3, 4, 5:
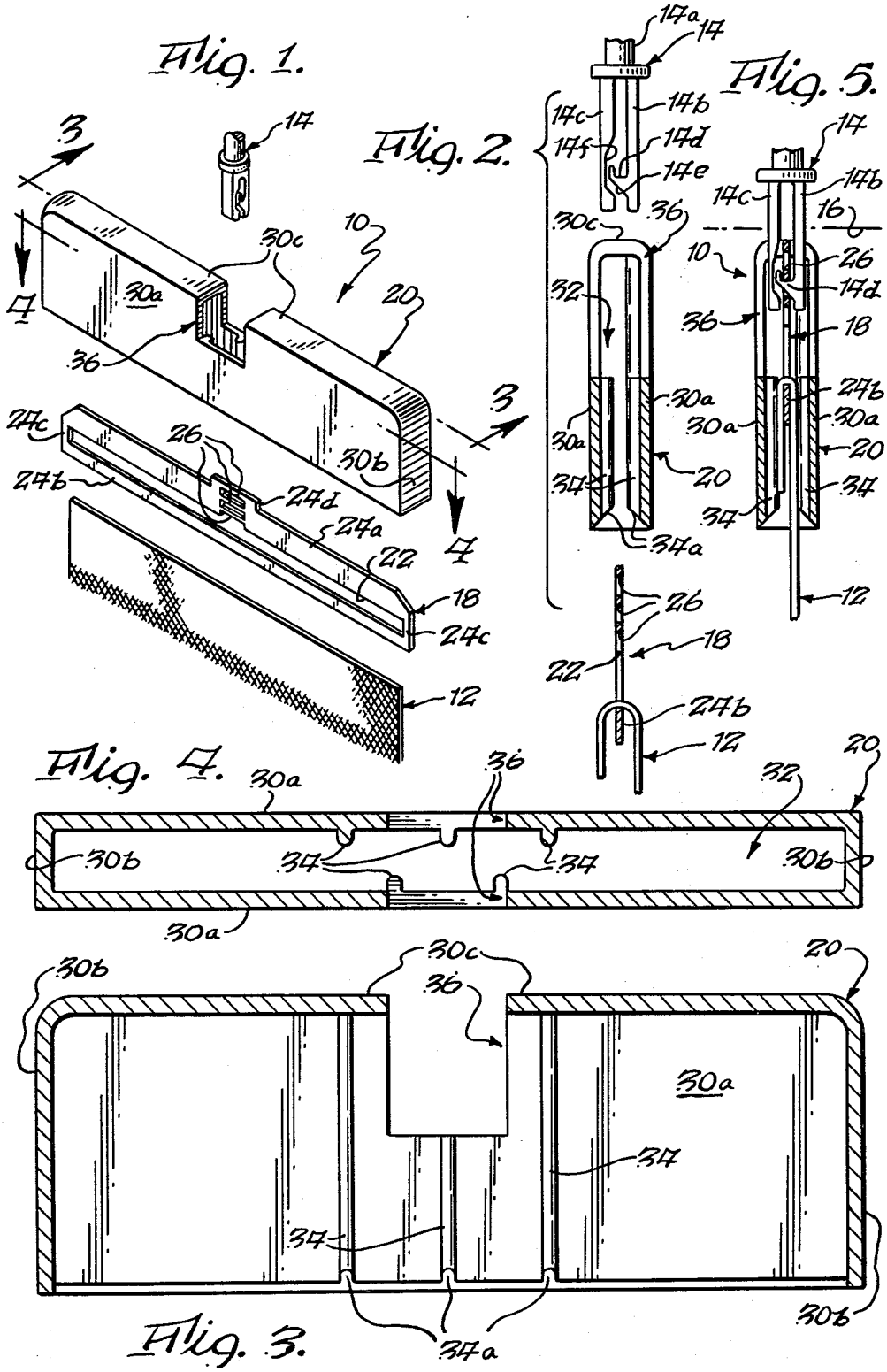
FIG. 1 is a perspective view of the vane assembly illustrating the various components thereof in their unassembled arrangement.
FIG. 2 is a vertical sectional view of the components illustrated in FIG. 1 depicting the vane folded through the slot in the vane holding bar.
FIG. 3 is a sectional view of the housing taking substantially along line 3—3 of FIG. 1.
FIG. 4 is a sectional view of the housing taken substantially along the line 4—4 of FIG. 1.
FIG. 5 is a view similar to FIG. 2, but illustrating the components in their assembled position and suspended by a hook of the type commonly employed in presently available venetian blind installations.

Reference is first made to FIG. 1, wherein a vane holding assembly of the present invention is generally designated as 10, and shown in association with a vertical, venetian blind type vane 12 and a vane supporting hook 14.

Vane 12 may be fabricated of any suitable, pliable vane forming material, including for instance, thin plastic sheet, cloth, fabric, treated paper, etc.; the only limitation being that such material is capable of being bent or folded for purposes of mounting same in association with the present vane holding assembly in the manner to be described.

Hook 14 is shown as being of the type commonly employed in presently available, rigid vane type venetian blind mechanisms, wherein such hook is supported by a carrier, not shown, for rotational movement about a vertically disposed axis, the carrier in turn being supported by a trackway, also not shown, for horizontally directed movement between blind open and closed positions. Typically, hook 14 depends or projects below a bottom surface of its associated trackway, which is generally designated by the broken line 16 in FIG. 5, through a distance sufficient to permit attachment of a vane thereto, while allowing some minimum clearance to exist between bottom surface 16 and the top of the vane. To facilitate the following description, hook 14 will be referred to as generally including a carrier associated stem portion 14*a*, which carries a pair of dependent and resiliently deformable arms 14*b* and 14*c*. The lower end of arm 14*b* is transversely enlarged to define an upwardly opening hook-shaped projection or member 14*d*, which is formed with a downwardly facing cam surface 14*e* and arranged to project partially within a recess 14*f* provided adjacent the lower end of arm 14*c*. In a typical installation, a rigid vane is provided with a mounting slot disposed to extend transversely adjacent its upper end and hook 14 attached to the vane by arranging arms 14*b* and 14*c* in a straddling relationship to the upper end of the vane and then forcing the hook to move lengthwise of the vane in order to cause the end of the vane to engage cam surface 14*e* and spread the arms apart sufficiently to allow the vane mounting slot to be positioned for receipt a hook-shaped member 14*d* therewithin. Upon insertion of hook-shaped member 14*d* within the vane mounting slot, the hook arms are free to return to their initial non-deformed condition and the vane is thereafter releasably supported for movements with the hook, during operation of the blind mechanism. Hooks of the type generally described above are disclosed for instance in U.S. Pat. Nos. 3,516,473; 4,122,884 and 4,140,169, whose disclosures are specifically incorporated herein by reference.

Vane holding assembly 10 is shown in FIGS. 1, 2 and 5 as generally including a vane holding bar 18, which serves to adjustably support vane 12 and interconnect the assembly with hook 14; and an elongated housing 20, which serves to receive the vane holding bar and frictionally clamp the vane in association therewith. The lower end of vane 12 may, as desired, be weighted or suitably secured to a conventional mechanism adapted to insure conjunctive movements of such lower end with the upper end of the vane associated with assembly 10.

Vane holding bar 18 is best shown in FIG. 1 as being in the form of an elongated, thin, flat plate having a lengthwise extending vane mounting slot 22, which serves to generally divide the holding bar into upper, lower and opposite end bar portions 24*a*, 24*b* and 24*c*, respectively, and a mounting tab 24*d*, which upstands or projects centrally from and is formed integrally with upper bar portion 24*a*. Mounting slot 22 is sized to permit the upper end of vane 12 to be passed therethrough for folding downwardly over lower bar portion 24*b*, as best shown in FIGS. 2 and 5.

By again referring to FIGS. 1, 2 and 5, it will be understood that mounting tab 24*d* and/or upper bar portion 24*a* is provided with one or more vertically spaced mounting slot openings 26, which are arranged centrally of holding bar 18 and disposed parallel to mounting slot 22 with which the lowermost of such mounting slot openings may, if desired, be placed in communication. It will also be understood by referring to FIG. 5, that mounting slot openings 26 are sized to removably receive hook projection 24*d* for assembly mounting purposes. Holding bar 18 may be formed of any suitable material, but preferably is fabricated of metal for strength purposes.

Housing 20 is shown in the drawings as being of a boxlike construction, wherein opposite side, opposite end and top walls 30*a*, 30*b* and 30*c*, respectively, cooperate to define a downwardly opening cavity 32, which is sized to receive holding bar 18 and the folded over upper end of vane 12 when disposed in an essentially coplanar relationship with side walls 30*a*. More specifically, housing 20 is preferably provided with means, such as may be defined by a plurality of ribs 34 formed integrally with side walls 30*a* and arranged to project within cavity 32, for use in frictionally retaining or clamping vane 12 in association with holding bar 18 incident to insertion thereof within the cavity. Preferably, ribs 34 extend vertically of side walls 30*a* in a staggered or horizontally offset relationship relative to one another, as best shown in FIG. 4, and have tapered lower ends 34*a* serving as guides to facilitate insertion of holding bar 18. If desired, the lower marginal edges of side walls 30*a* may also be tapered in the manner shown in FIGS. 2, 3 and 5. The spacing between ribs 34, as measured transversely between side walls 30*a*, is such as to permit frictional gripping or clamping of the folded over upper end of vane 12 when holding bar 18 is inserted upwardly within cavity 32 in the manner shown in FIG. 5. On the other hand, the spacing between facing surfaces of end walls 30*b* is such as to permit holding bar 18 to be freely inserted outwardly within cavity 32. Frictional gripping or clamping of the folded vane may be facilitated by forming housing 16 from a plastic or other suitable material capable of permitting side walls 30*a* to undergo some degree of resilient deformation or flexing, as desired.

Housing top wall 30*c*, and preferably also the upper portions of side walls 30*a*, are cut away to define a centrally located upper opening 36, which is sized to receive and permit flexure of hook legs 14*b* and 14*c*, as well as mounting tab 24*d*, as best shown in FIG. 5. Preferably, the lengthwise dimension of opening 36, as measured between end walls 30*b*, is such as to freely receive tab 24*d* and hook legs 14*b* and 14*c*, while at the same time serving to prevent any substantial movement of the tab, as would result in movement of holding bar 18 and thus vane 12 from a centered relationship relative to housing 20. The vertical dimension of opening 36, i.e. the height of the cutouts provided in side walls 30*a*, will be determined by the number of desired adjusted mounting positions of hook 14 relative to holding bar 18, as defined by the number and positioning of slot mounting openings 26. In the preferred construction of the present vane holding assembly illustrated in the drawings, three slot mounting openings 26 are provided with a view towards accommodating the present invention for use in mounting vanes in association with essentially all major presently available commercial blind mechanisms of the type employing hooks 14 of the construction previously described. Also in the preferred construction, the height of tab 24*d* is chosen to correspond essentially to the thickness of upper wall 30*c*, such that the upper edge of the tab lies flush with the upper surface of the upper wall, when the upper marginal edge of upper bar portion 24*a* lies in abutting engagement with the lower or inner surface of the upper wall.

In assembling the components of vane holding assembly 10, as thus far described, the upper end of vane 12 is first inserted through mounting slot 22 and then folded over lower bar portion 24*b* to an extent which will provide a vane of desired length when the assembly is subsequently connected to hook 14. Holding bar 18, together with the folded over vane, is then inserted within housing cavity 32, until tab 24*d* is fully inserted within openings 36 and the upper marginal edge of upper bar portion 24*a* is seated in underlying engagement with upper wall 30*c*. As an incident to insertion of holding bar 18, ribs 34 engage with the folded over end of vane 12 and press same into surface to surface engagement with the opposite side surfaces of lower bar portion 24*b*, whereupon the vane is snugly clamped or frictionally gripped within the housing. Flexure of side walls 30*a* may be relied upon to increase the gripping force and/or to accommodate assembly 10 to receive vanes formed of materials differing substantially in thickness. After assembly of vane holding assembly 10 has been completed, the assembly is then brought into association with hook 14 such that tab 24*d* engages with projection cam surface 14*e* in order to effect spreading of hook legs 14*b* and 14*c* and permit subsequent positioning of projection 14*d* within a selected one of slot mounted openings 26. Preferably, projection 14*d* will be inserted within that one of slot mounting openings 26, which enables a minimum working clearance to be maintained between the upper surface of housing wall 30*c* and bottom surface 16 of an associated trackway. For purposes of disassembly or relocation of projection 14*b* within another of mounting slot openings 26, it is simply necessary to manually spread hook legs 14*b* and 14*c* sufficiently to permit withdrawal or removal of projection from the slot mounting opening in which it had been positioned. After mounting of vane holding assembly 10 on hook 14, the length of or the degree of tension applied to vane 12 may be adjusted, as for instance by pulling down on the folded over or free upper edge of the vane; access thereto being facilitated by the relatively wide spacing existing between the inner surfaces of side walls 30*a*, as compared to the composite thickness of holding bar and folded vane, and/or by flexure of such side walls.

From the foregoing description, it will be apparent that the vane holding assembly of the present invention provides an efficient, simple and economical arrangement for permitting vanes formed of a pliable material to be removably and adjustably retained in association with the hook of a conventional vertical blind mechanism. Moreover, the provision of multiple mounting slot openings in the holding bar accommodates the present assembly and associated vane for use with diverse types of presently available commercial vertical blind mechanisms, whereas the provision in the holding bar of an elongated slot for receiving the vane and the provision of ribs on the housing provides a simple mode of attaching the vane to the holding assembly in a manner readily accommodating for adjustments in the length of the vane required for instance by vane material shrinkage. Still further, the provision of a housing constructed in the manner illustrated in the drawings, not only provides a convenient mechanism for releasably retaining a vane in association with the mounting bar, but additionally provides an aesthetically pleasing enclosure for hiding the holding bar and folded over vane from view.

Although only a preferred embodiment of the present invention has been illustrated and described, it is intended that the scope of protection afforded the invention be limited only by the breadth of the appended claims.

What is claimed is:

1. A vane holding assembly for suspending a vertical vane formed of a pliable material from a hook of a venetian blind mechanism, said assembly comprising:

an elongated housing defining a downwardly opening cavity and an upper opening providing for insertion of said hook into said cavity; and an elongated vane holding bar for insertion into said cavity for connection with said hook adjacent said upper opening, said holding bar having a lengthwise extending mounting slot for receiving an upper end of said vane in folded relation through said mounting slot, said housing having means for frictionally securing said folded vane to said holding bar incident to insertion thereof within said cavity.

2. The assembly according to claim 1, wherein said housing includes opposite elongated side walls serving in part to bound said cavity, and said means comprises a plurality of ribs carried by each of said side walls to project inwardly of said cavity for engagement with said folded vane on opposite sides of said holding bar.

3. The assembly according to claim 1 or 2, wherein said holding bar includes a transversely projecting tab sized to be positionally located within said upper opening and a plurality of vertically spaced slot mounting openings sized to selectively receive said hook for connecting said holding bar to said hook.

4. The assembly according to claim 1, wherein said housing includes opposite elongated side walls, opposite end walls and a top wall cooperating to define said cavity, at least said top wall being centrally apertured to define said upper openings, said holding bar is in the form of a flat plate sized for insertion within said cavity to lie essentially coplanar with said side walls, said holding bar having upper, lower and opposite end bar portions cooperating to bound said mounting slot, said mounting slot receiving said vane to permit folding thereof downwardly about said lower bar portion, and said upper bar portion defining at least one mounting slot opening disposed centrally thereof for alignment with said upper opening and sized to removably receive said hook for connection of said holding bar thereto.

5. The assembly according to claim 4, wherein said holding bar is provided with a tab projecting centrally of said upper bar portion for receipt within said upper opening, and said tab and said upper bar portion cooperating to define a plurality of said mounting slot openings arranged in vertical alignment and to extend parallel to said mounting slot.

6. The assembly according to claim 4 or 5, wherein said means comprises a plurality of vertically disposed ribs carried by said side walls to project inwardly of said cavity for engagement with said folded vane on opposite sides of said lower bar portion, and said housing is formed of a resiliently deformable material permitting flexure of said side walls relative to one another.

* * * * *